United States Patent [19]

Miyaji

[11] Patent Number: 4,825,180

[45] Date of Patent: Apr. 25, 1989

[54] SOLENOID SWITCH FOR USE IN ENGINE STARTER MOTOR

[75] Inventor: Wakaki Miyaji, Hyogo, Japan

[73] Assignee: Mitsubishi Denki Kabushiki Kaisha, Tokyo, Japan

[21] Appl. No.: 206,779

[22] Filed: Jun. 15, 1988

[30] Foreign Application Priority Data

Jun. 15, 1987 [JP] Japan ..... 62-92219

[51] Int. Cl.[4] ..... H01H 51/08

[52] U.S. Cl. ..... 335/131; 335/126

[58] Field of Search ..... 335/131, 126, 255

[56] References Cited

U.S. PATENT DOCUMENTS 4,637,267 1/1987 Mazzorana ..... 335/131

4,755,781 7/1988 Bögner ..... 335/131

*Primary Examiner*—H. Broome

*Attorney, Agent, or Firm*—Sughrue, Mion, Zinn, Macpeak and Seas

[57] ABSTRACT

A rod having a movable contact is prepared separately from a plunger and inserted relatively movably thereinto for a limited distance so that the movable contact is kept stationary until the plunger moves by a considerable distance. Therefore, a contact gap between the movable contact and a stationary contact can be made much smaller than that required in the conventional switch and hence the overall length of the solenoid switch can be made smaller.

1 Claim, 2 Drawing Sheets

SOLENOID SWITCH FOR USE IN ENGINE STARTER MOTOR

BACKGROUND OF THE INVENTION

The present invention relates to a solenoid switch for use in an engine starter motor.

A typical example of a conventional solenoid switch of a starter motor is shown in FIG. 2, in which a reference numeral 1 depicts a case 2 a stationary core which is integral with the case 1, 3 a plunger provided opposingly to the stationary core 2, 4 a plunger spring provided between the stationary core 2 and the plunger 3, 5 a solenoid wound on a bobbin 6 fitted around the stationary core 2 and the plunger 3, 7 a movable contact mounted on an end of the plunger 3, 8 a cap which is integral with the case 1 and the stationary core 2, 9 a fixed contact fixedly mounted on the cap 8, 10 a movable member having at an end thereof a hook 10*a* and inserted into the plunger 3 movably and 11 a lever spring inserted in between the plunger 3 and the movable member 10. A reference numeral 12 depicts a lever mechanically connected to a pinion mounted on a rotary shaft of a starter motor.

In operation, when an electric current is supplied to the solenoid 5, the plunger 3 is attracted to the stationary core 2 magnetically so that the movable member 10 is also moved through the lever spring 11 to rotate the lever 12. Upon the rotation of the lever 12, the pinion connected to the lever 12 is moved to mesh with a ring gear of an engine. During this operation, the movable contact 7 is made in contact with the stationary contact 9 to start the motor to thereby start the engine.

In such conventional solenoid switch, a distance along which the movable contact 7 can move is equal to a moving distance of the plunger 3 due to the integrity thereof and, therefore, it is necessary to select the distance l (contact gap) large, causing a longitudinal length of the solenoid switch to be long.

SUMMARY OF THE INVENTION

An object of the present invention is to provide a solenoid switch of an engine starter motor, the length of which can be minimized by minimizing the contact gap l.

The above object can be achieved according to the present invention by providing a rod having a movable contact separately from a plunger and inserted movably into the plunger. The rod is formed with a protrusion thereon which is engageable with the plunger around a half way of its stroke.

In the present invention, the rod is kept stationarily during an initial portion of the stroke of the plunger to the stationary core magnetized by the energized solenoid. When the protrusion of the rod engages with the plunger, the rod starts to move together with the plunger so that the movable contact thereon contacts with the stationary contact.

DETAILED DESCRIPTION OF THE PREFERRED EMBODIMENT

Figure 1:
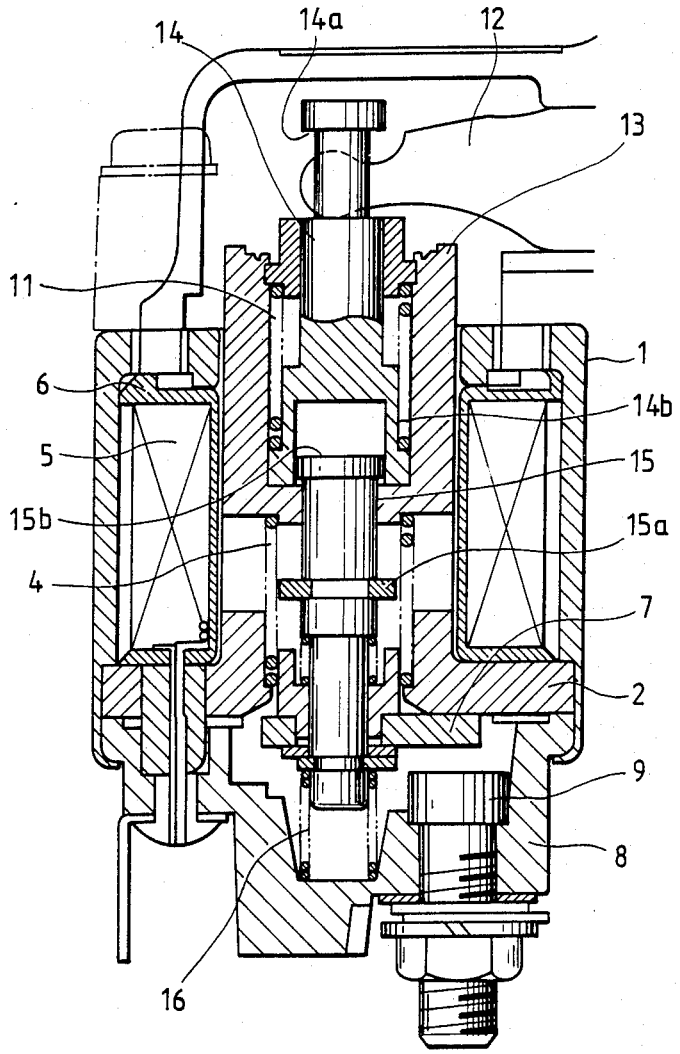
FIG. 1 shows an embodiment of the present invention in cross section.
Figure 2:
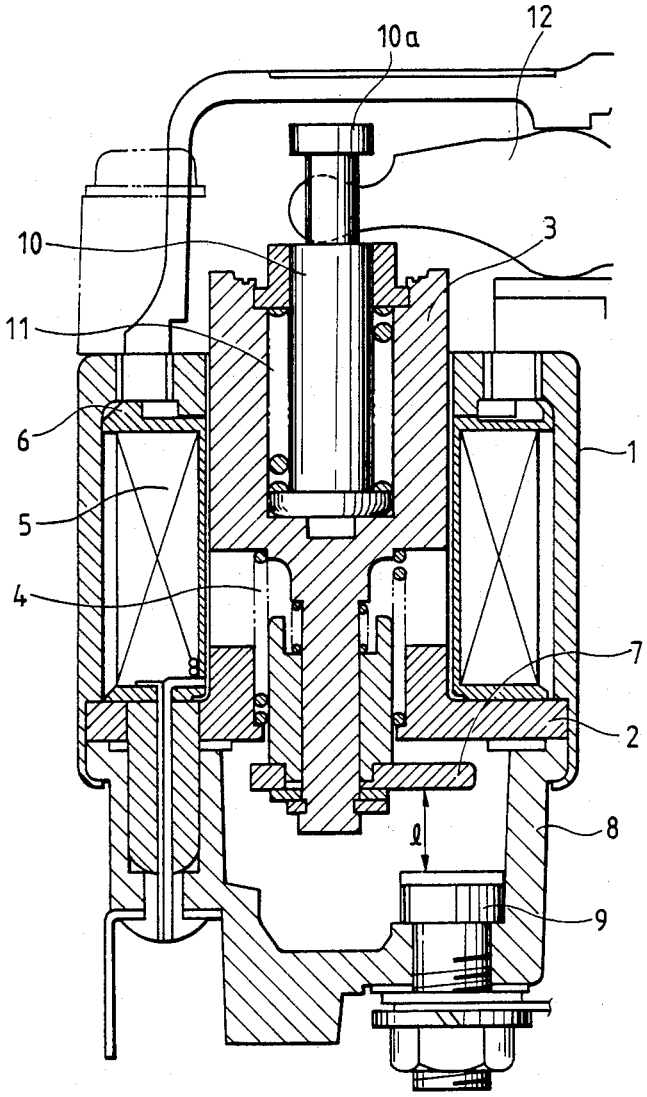
FIG. 2 PRIOR ART
FIG. 2 shows a conventional solenoid switch in cross section.

In FIG. 1 in which same reference numerals as those used in FIG. 2 depict same or corresponding portions, respectively, a reference numeral 13 depicts a plunger provided opposingly to a stationary core 2, into which a movable member 14 is inserted. The movable member 14 has at one end thereof a hook 14*a* adapted to engage with a lever 12 and is formed at the other end thereof with a recess 14*b*. A rod 15 has one end 15*a* which has a large diameter and is received by the recess 14*b* of the plunger 14 undetachably therefrom while being allowed to axially move therein and an intermediate portion on which a protrusion 15*a* in the form of a stopper ring is mounted. A movable contact 7 is fixedly mounted on the other end of the rod 15 opposingly to a stationary contact 9. A return spring 16 is provided between the other end of the rod 15 and a cap 8 to bias the rod upwardly.

Describing an operation of the embodiment of the present invention having a structure mentioned above, when a current is supplied to a solenoid 5, the plunger, 13 is magnetically attracted by the stationary core 2 and moved toward the latter while the rod 15 is kept stationarily until a lower end of the plunger 14 reaches the protrusion 15*a* of the rod 15 due to a space between the protrusion 15*a* of the rod 15 and a bottom of the recess 14*b*.

When the lower end of the plunger 14 contacts with the protrusion 15*a* of the rod 15, the latter starts to move downwardly together with the plunger 14 until the movable contact fixed on the lower end of the rod 15 contacts with the stationary contact 9. Therefore, a distance of movement of the movable contact 7 becomes much shorter than the distance l in the conventional switch shown in FIG. 2.

When the current to the solenoid 5 is cut off, the movable contact 7 is separated from the stationary contact 9 due to the biasing force of the return spring 16. The plunger spring may assist the separation of the movable contact 7 from the stationary contact 9 when the spring force of the return spring 6 becomes not enough due to some reasons, causing a contact welding to hardly occur.

As mentioned hereinbefore, according to the present invention, the rod having the movable contact is prepared separately from the plunger and inserted relatively movably thereinto for a limited distance so that the movable contact is kept stationary until the plunger moves by a considerable distance. Therefore, the contact gap can be made much smaller than that required in the conventional switch and hence the overall length of the solenoid switch can be made smaller.

What is claimed is:

1. A solenoid switch for an engine starter motor comprising a stationary core fixedly mounted on a casing, a plunger provided movably and opposingly to said stationary core, a solenoid surrounding said stationary core and said plunger, a stationary contact fixedly mounted on said casing, a plunger spring provided between said stationary core and said plunger for biasing said plunger from said stationary core, a movable member inserted into said plunger axially movably, said movable member having an engaging portion engaging with a lever for mechanically engaging an engine shaft with a rotary shaft of the engine starter motor, a lever spring provided between said movable member and said plunger for biasing said movable member into said plunger, a rod inserted axially movably into said plunger by a limited distance and having a protrusion adapted to be in contact with said plunger in a midway of a stroke of said plunger, a movable contact fixedly mounted on said rod opposingly to said stationary contact and a return spring provided between said rod and said casing for biasing said rod from said stationary contact.

* * * * *